US010774402B2

(12) United States Patent
Thomas et al.

(10) Patent No.: US 10,774,402 B2
(45) Date of Patent: Sep. 15, 2020

(54) REINFORCEMENT MATERIAL BLENDS WITH A SMALL PARTICLE METALLIC COMPONENT FOR METAL-MATRIX COMPOSITES

(71) Applicant: Halliburton Energy Services, Inc., Houston, TX (US)

(72) Inventors: Jeffrey G. Thomas, Magnolia, TX (US); Garrett T. Olsen, The Woodlands, TX (US); Alec C. Murchie, Saint Peters, MO (US)

(73) Assignee: Halliburton Energy Services, Inc., Houston, TX (US)

( * ) Notice: Subject to any disclaimer, the term of this patent is extended or adjusted under 35 U.S.C. 154(b) by 311 days.

(21) Appl. No.: 15/737,746

(22) PCT Filed: May 18, 2016

(86) PCT No.: PCT/US2016/033047

§ 371 (c)(1),
(2) Date: Dec. 18, 2017

(87) PCT Pub. No.: WO2017/003574

PCT Pub. Date: Jan. 5, 2017

(65) Prior Publication Data

US 2018/0179616 A1 Jun. 28, 2018

Related U.S. Application Data

(60) Provisional application No. 62/181,915, filed on Jun. 19, 2015.

(51) Int. Cl.
*E21B 10/46* (2006.01)
*E21B 10/00* (2006.01)
(Continued)

(52) U.S. Cl.
CPC ..... *C22C 29/08* (2013.01); *B22F 5/00* (2013.01); *C22C 1/0491* (2013.01);
(Continued)

(58) Field of Classification Search
CPC ..... E21B 10/46; E21B 10/00; E21B 10/54; C22C 29/08; C22C 1/0491; C22C 29/02
See application file for complete search history.

(56) References Cited

U.S. PATENT DOCUMENTS 5,589,268 A * 12/1996 Kelley ..... B22F 1/0014 428/408
5,662,183 A 9/1997 Fang
(Continued)

FOREIGN PATENT DOCUMENTS

CN 1042499 5/1990
CN 1042500 5/1990
(Continued)

OTHER PUBLICATIONS

International Search Report and Written Opinion from PCT/US2016/033047, dated Jan. 20, 2017, 15 pages.
(Continued)

*Primary Examiner* — Cathleen R Hutchins
(74) *Attorney, Agent, or Firm* — Thomas Rooney; C. Tumey Law Group PLLC

(57) ABSTRACT

A metal-matrix composite includes a reinforced composite material including reinforcement material dispersed in a binder material. The reinforcement material includes a metallic component dispersed with reinforcing particles and at least 25 percent of the metallic component has a particle size of 50 microns or less.

21 Claims, 6 Drawing Sheets

(51) Int. Cl.

| | |
|---|---|
| ***E21B 10/54*** | (2006.01) |
| ***C22C 29/08*** | (2006.01) |
| ***C22C 29/02*** | (2006.01) |
| ***C22C 1/04*** | (2006.01) |
| ***C22C 1/10*** | (2006.01) |
| ***C22C 32/00*** | (2006.01) |
| ***B22F 5/00*** | (2006.01) |

(52) U.S. Cl.

CPC ..... *C22C 1/1036* (2013.01); *C22C 29/02* (2013.01); *C22C 32/0052* (2013.01); *E21B 10/46* (2013.01); *E21B 10/54* (2013.01); *B22F 2005/001* (2013.01)

(56) References Cited

U.S. PATENT DOCUMENTS

| | | | | |
|---|---|---|---|---|
| 5,733,664 | A | 3/1998 | Kelley et al. | |
| 6,287,360 | B1 | 9/2001 | Kembaiyan et al. | |
| 6,984,454 | B2 * | 1/2006 | Majagi ..... | B22F 3/26 428/212 |
| 7,475,743 | B2 | 1/2009 | Liang et al. | |
| 8,074,750 | B2 | 12/2011 | Choe et al. | |
| 8,109,177 | B2 | 2/2012 | Kembaiyan | |
| 8,211,203 | B2 | 7/2012 | Sheng et al. | |
| 8,342,268 | B2 | 1/2013 | Lockstedt et al. | |
| 8,381,845 | B2 | 2/2013 | Lockwood | |
| 2008/0209818 | A1 | 9/2008 | Belnap et al. | |
| 2008/0282618 | A1 * | 11/2008 | Lockwood ..... | C23C 24/08 51/295 |
| 2010/0320004 | A1 | 12/2010 | Deng et al. | |
| 2013/0180786 | A1 | 7/2013 | Thomas et al. | |

FOREIGN PATENT DOCUMENTS

| | | |
|---|---|---|
| CN | 102439257 | 5/2012 |
| WO | WO-2015088560 A1 | 6/2015 |

OTHER PUBLICATIONS

Chinese Search Report for Application No. 201680021356.0 dated Sep. 26, 2018.

* cited by examiner

REINFORCEMENT MATERIAL BLENDS WITH A SMALL PARTICLE METALLIC COMPONENT FOR METAL-MATRIX COMPOSITES

BACKGROUND

A wide variety of tools are used in the oil and gas industry for forming wellbores, completing drilled wellbores, and producing hydrocarbons from completed wellbores. Examples of wellbore-forming tools include cutting tools, such as drill bits, mills, and borehole reamers. Drill bits and other tools may be formed from metal matrix composites (MMCs), and may be referred to herein as "MMC tools."

An MMC tool is typically manufactured by depositing matrix reinforcement material into a mold cavity designed to form various external and internal features of the MMC tool. Interior surfaces of the mold cavity may be shaped to form desired external features of the MMC tool. Temporary displacement materials, such as consolidated sand or graphite, may be positioned within interior portions of the mold cavity to form various internal (or external) features of the MMC tool. A binder material may be added to the mold cavity, and the mold may be placed within a furnace to liquefy the binder material and thereby allow the binder material to infiltrate the reinforcing particles of the matrix reinforcement material.

MMC tools may be erosion-resistant and exhibit high impact strength. However, depending on the particular materials used, MMC materials can also be brittle and, as a result, stress cracks can occur as a result of thermal stress experienced during manufacturing or operation, or as a result of mechanical stress experienced during use.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
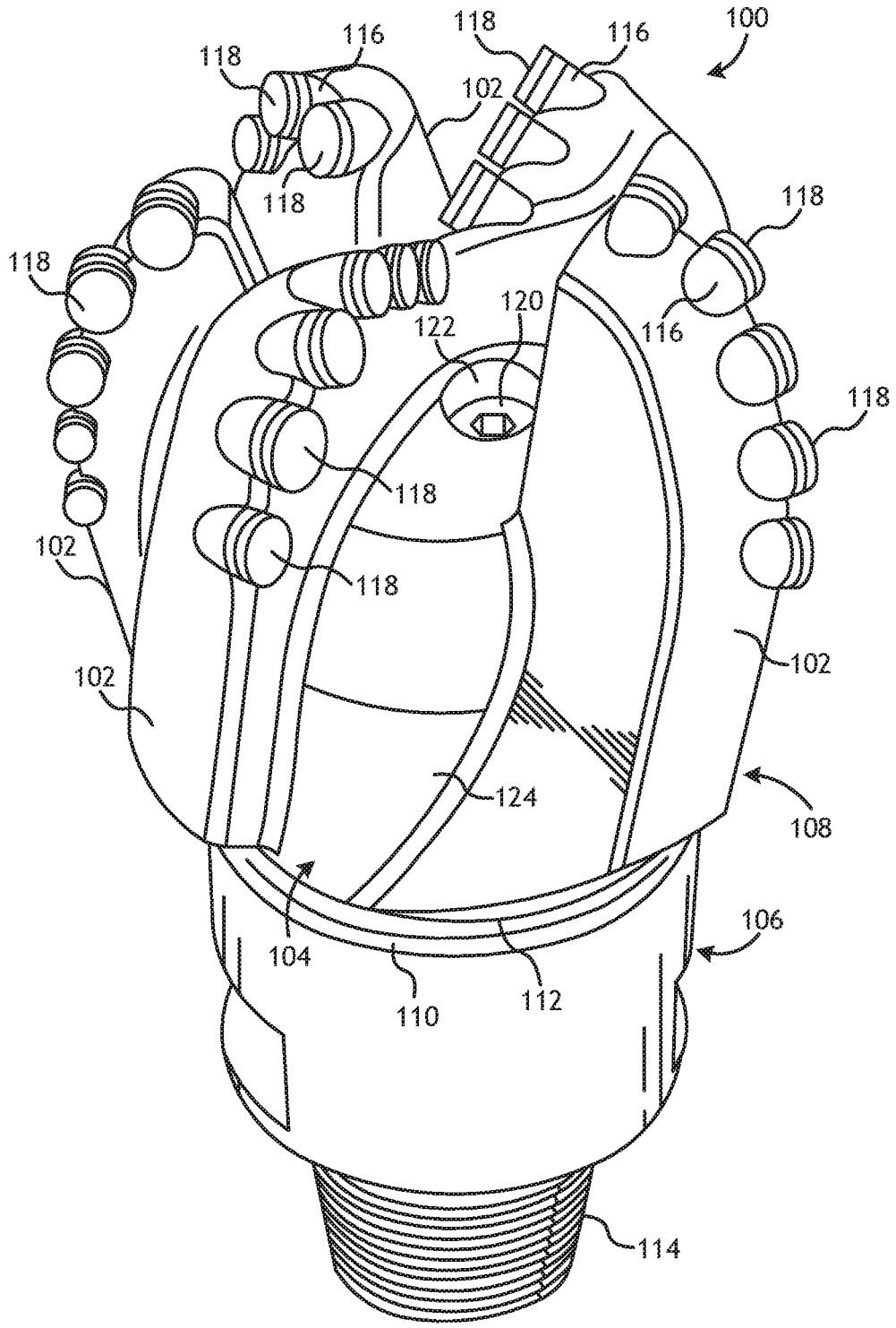
FIG. 1 is a perspective view of an example metal-matrix composite tool that may be fabricated in accordance with the principles of the present disclosure.

The present disclosure relates to tool manufacturing and, more particularly, to reinforcement material blends for metal-matrix composite tools that include a metallic component with optimized sizing and distribution. The embodiments described herein may be used to fabricate infiltrated metal-matrix composites and metal-matrix composite tools.

Metal-matrix composite tools described herein may include reinforcement materials infiltrated with a binder material and including a metallic component blended therewith. According to the present disclosure, the metallic component may be dispersed with reinforcing particles in the range of about 2 wt % to about 15 wt %, where at least 25 percent of the metallic component exhibits a particle size of 50 microns or less. The strength, ductility, toughness, and erosion-resistance of the resulting metal-matrix composite tools may be improved by incorporating the metallic component into the reinforcement material as described and discussed herein.

Embodiments of the present disclosure are applicable to any tool or part formed as a metal matrix composite (MMC). For instance, the principles of the present disclosure may be applied to the fabrication of tools or parts commonly used in the oil and gas industry for the exploration and recovery of hydrocarbons. Such tools and parts include, but are not limited to, oilfield drill bits or cutting tools (e.g., fixed-angle drill bits, roller-cone drill bits, coring drill bits, bi-center drill bits, impregnated drill bits, reamers, stabilizers, hole openers, cutters), non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, washover tools, rotors, stators and/or housings for downhole drilling motors, blades and housings for downhole turbines, and other downhole tools having complex configurations and/or asymmetric geometries associated with forming a wellbore.

The principles of the present disclosure, however, may be equally applicable to any type of MMC used in any industry or field. For instance, the methods described herein may also be applied to fabricating armor plating, automotive components (e.g., sleeves, cylinder liners, driveshafts, exhaust valves, brake rotors), bicycle frames, brake fins, wear pads, aerospace components (e.g., landing-gear components, structural tubes, struts, shafts, links, ducts, waveguides, guide vanes, rotor-blade sleeves, ventral fins, actuators, exhaust structures, cases, frames, fuel nozzles), turbopump and compressor components, a screen, a filter, and a porous catalyst, without departing from the scope of the disclosure. Those skilled in the art will readily appreciate that the foregoing list is not a comprehensive listing, but only exemplary. Accordingly, the foregoing listing of parts and/or components should not limit the scope of the present disclosure.

FIG. 1 is a perspective view of an example MMC tool 100 that may be fabricated in accordance with the principles of the present disclosure. The MMC tool 100 is generally depicted in FIG. 1 as a fixed-cutter drill bit that may be used in the oil and gas industry to drill wellbores. Accordingly, the MMC tool 100 will be referred to herein as the "drill bit 100," but as indicated above, the drill bit 100 may alternatively be replaced with any type of MMC tool or part used in the oil and gas industry or any other industry, without departing from the scope of the disclosure.

As illustrated in FIG. 1, the drill bit 100 may provide a plurality of cutter blades 102 angularly spaced from each other about the circumference of a bit head 104. The bit head 104 is connected to a shank 106 to form a bit body 108. The shank 106 may be connected to the bit head 104 by welding, such as through laser arc welding that results in the formation of a weld 110 around a weld groove 112. The shank 106 may further include a threaded pin 114, such as an American Petroleum Institute (API) drill pipe thread used to connect the drill bit 100 to drill pipe (not shown).

In the depicted example, the drill bit 100 includes five cutter blades 102 in which multiple recesses or pockets 116 are formed. A cutting element 118 (alternately referred to as a "cutter") may be fixedly installed within each recess 116. This can be done, for example, by brazing each cutting element 118 into a corresponding recess 116. As the drill bit 100 is rotated in use, the cutting elements 118 engage the rock and underlying earthen materials, to dig, scrape or grind away the material of the formation being penetrated.

During drilling operations, drilling fluid or "mud" can be pumped downhole through a drill string (not shown) coupled to the drill bit 100 at the threaded pin 114. The drilling fluid circulates through and out of the drill bit 100 at one or more nozzles 120 positioned in nozzle openings 122 defined in the bit head 104. Junk slots 124 are formed between each angularly adjacent pair of cutter blades 102. Cuttings, downhole debris, formation fluids, drilling fluid, etc., may pass through the junk slots 124 and circulate back to the well surface within an annulus formed between exterior portions of the drill string and the inner wall of the wellbore being drilled.

Figure 2:
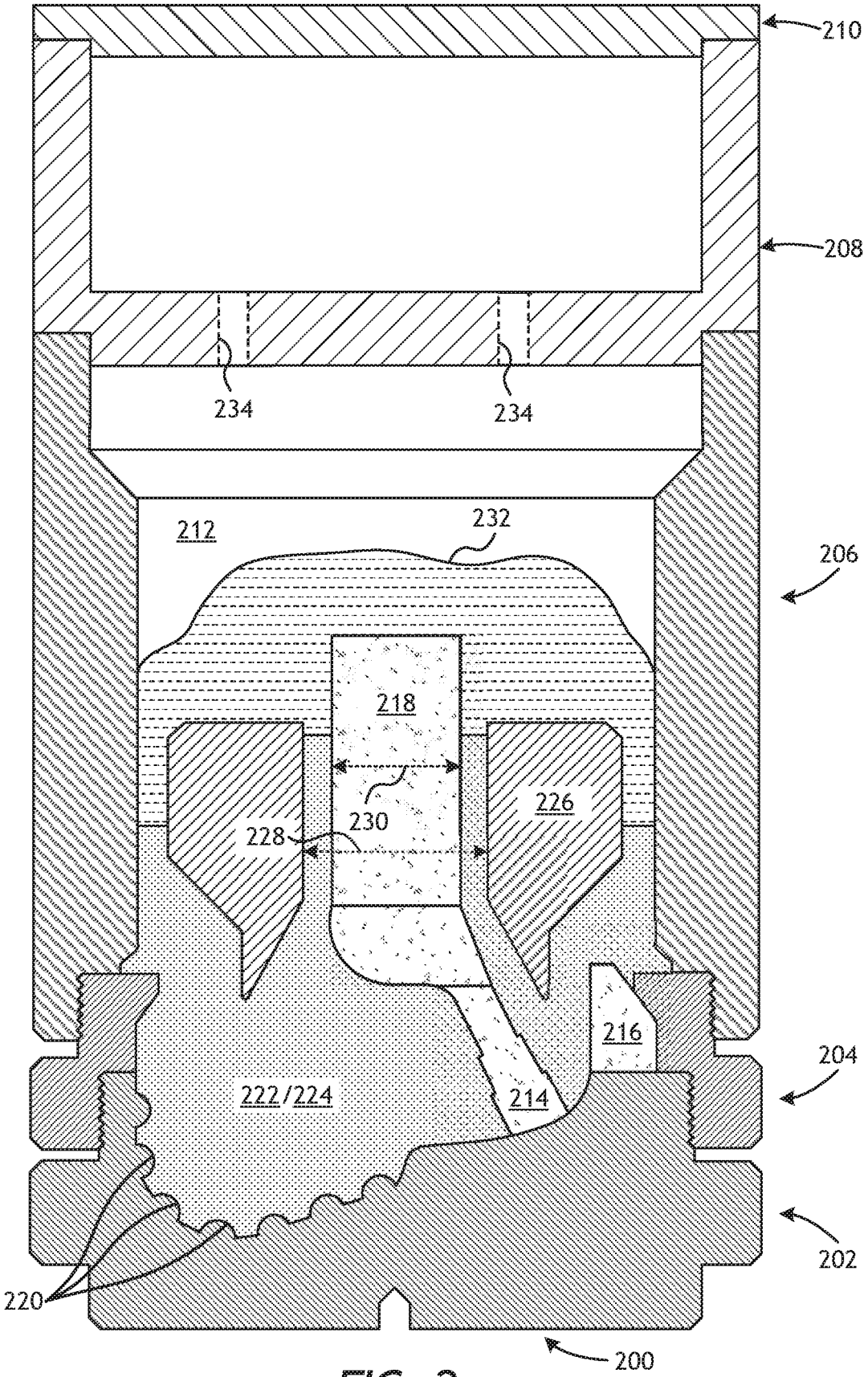
FIG. 2 is a cross-sectional side view of an exemplary mold assembly for use in forming the drill bit of FIG. 1.

FIG. 2 is a cross-sectional side view of a mold assembly 200 that may be used to form the drill bit 100 of FIG. 1. While the mold assembly 200 is shown and discussed as being used to help fabricate the drill bit 100, a variety of variations of the mold assembly 200 may be used to fabricate any of the MMC tools mentioned above, without departing from the scope of the disclosure. As illustrated, the mold assembly 200 may include several components such as a mold 202, a gauge ring 204, and a funnel 206. In some embodiments, the funnel 206 may be operatively coupled to the mold 202 via the gauge ring 204, such as by corresponding threaded engagements, as illustrated. In other embodiments, the gauge ring 204 may be omitted from the mold assembly 200 and the funnel 206 may instead be operatively coupled directly to the mold 202, such as via a corresponding threaded engagement, without departing from the scope of the disclosure.

In some embodiments, as illustrated, the mold assembly 200 may further include a binder bowl 208 and a cap 210 placed above the funnel 206. The mold 202, the gauge ring 204, the funnel 206, the binder bowl 208, and the cap 210 may each be made of or otherwise comprise graphite or alumina ($Al_2O_3$), for example, or other suitable materials. An infiltration chamber 212 may be defined within the mold assembly 200. Various techniques may be used to manufacture the mold assembly 200 and its components including, but not limited to, machining graphite blanks to produce the various components and thereby define the infiltration chamber 212 to exhibit a negative or reverse profile of desired exterior features of the drill bit 100 (FIG. 1).

Materials, such as consolidated sand or graphite, may be positioned within the mold assembly 200 at desired locations to form various features of the drill bit 100 (FIG. 1). For example, one or more nozzle or leg displacements 214 (one shown) may be positioned to correspond with desired locations and configurations of flow passageways defined through the drill bit 100 and their respective nozzle openings (i.e., the nozzle openings 122 of FIG. 1). One or more junk slot displacements 216 may also be positioned within the mold assembly 200 to correspond with the junk slots 124 (FIG. 1). Moreover, a cylindrically shaped central displacement 218 may be placed on the leg displacements 214. The number of leg displacements 214 extending from the central displacement 218 will depend upon the desired number of flow passageways and corresponding nozzle openings 122 in the drill bit 100. Further, cutter-pocket displacements 220 may be defined in the mold 202 or included therewith to form the cutter pockets 116 (FIG. 1). In the illustrated embodiment, the cutter-pocket displacements 220 are shown as forming an integral part of the mold 202.

After the desired displacement materials have been installed within the mold assembly 200, a reinforcement material 222 may then be placed within or otherwise introduced into the mold assembly 200. According to embodiments of the present disclosure, a metallic component 224 may be dispersed with the reinforcement material 222 and simultaneously introduced into the mold assembly 200. As used herein, the term "disperse" can refer to a homogeneous or a heterogeneous mixture, combination, or blend of the reinforcement material 222 and the metallic component 224. As described herein below, the blend of the metallic component 224 and the reinforcement material 222 results in a custom reinforcement material that may prove advantageous in adding strength and ductility to the resulting MMC tool (e.g., the drill bit 100 of FIG. 1) and may also improve erosion resistance.

In some embodiments, a mandrel 226 (alternately referred to as a "metal blank") may be supported at least partially by the reinforcement material 222 and the metallic component 224 within the infiltration chamber 212. More particularly, after a sufficient volume of the reinforcement material 222 and the metallic component 224 has been added to the mold assembly 200, the mandrel 226 may be situated within mold assembly 200. The mandrel 226 may include an inside diameter 228 that is greater than an outside diameter 230 of the central displacement 218, and various fixtures (not expressly shown) may be used to properly position the mandrel 226 within the mold assembly 200 at a desired location. The blend of the reinforcement material 222 and the metallic component 224 may then be filled to a desired level within the infiltration chamber 212 around the mandrel and the central displacement 218.

Binder material 232 may then be placed on top of the blend of the reinforcement material 222 and the metallic component 224, the mandrel 226, and the central displacement 218. In some embodiments, the binder material 232 may be covered with a flux layer (not expressly shown). The amount of binder material 232 (and optional flux material) added to the infiltration chamber 212 should be at least enough to infiltrate the reinforcement material 222 and the metallic component 224 during the infiltration process. In some instances, some or all of the binder material 232 may be placed in the binder bowl 208, which may be used to distribute the binder material 232 into the infiltration chamber 212 via various conduits 234 that extend therethrough. The cap 210 (if used) may then be placed over the mold assembly 200.

The mold assembly 200 and the materials disposed therein may then be preheated and subsequently placed in a furnace (not shown). When the furnace temperature reaches the melting point of the binder material 232, the binder material 232 will liquefy and proceed to infiltrate the reinforcement material 222 and the metallic component 224. After a predetermined amount of time allotted for the liquefied binder material 232 to infiltrate the reinforcement material 222 and the metallic component 224, the mold assembly 200 may then be removed from the furnace and cooled at a controlled rate.

Figure 3:
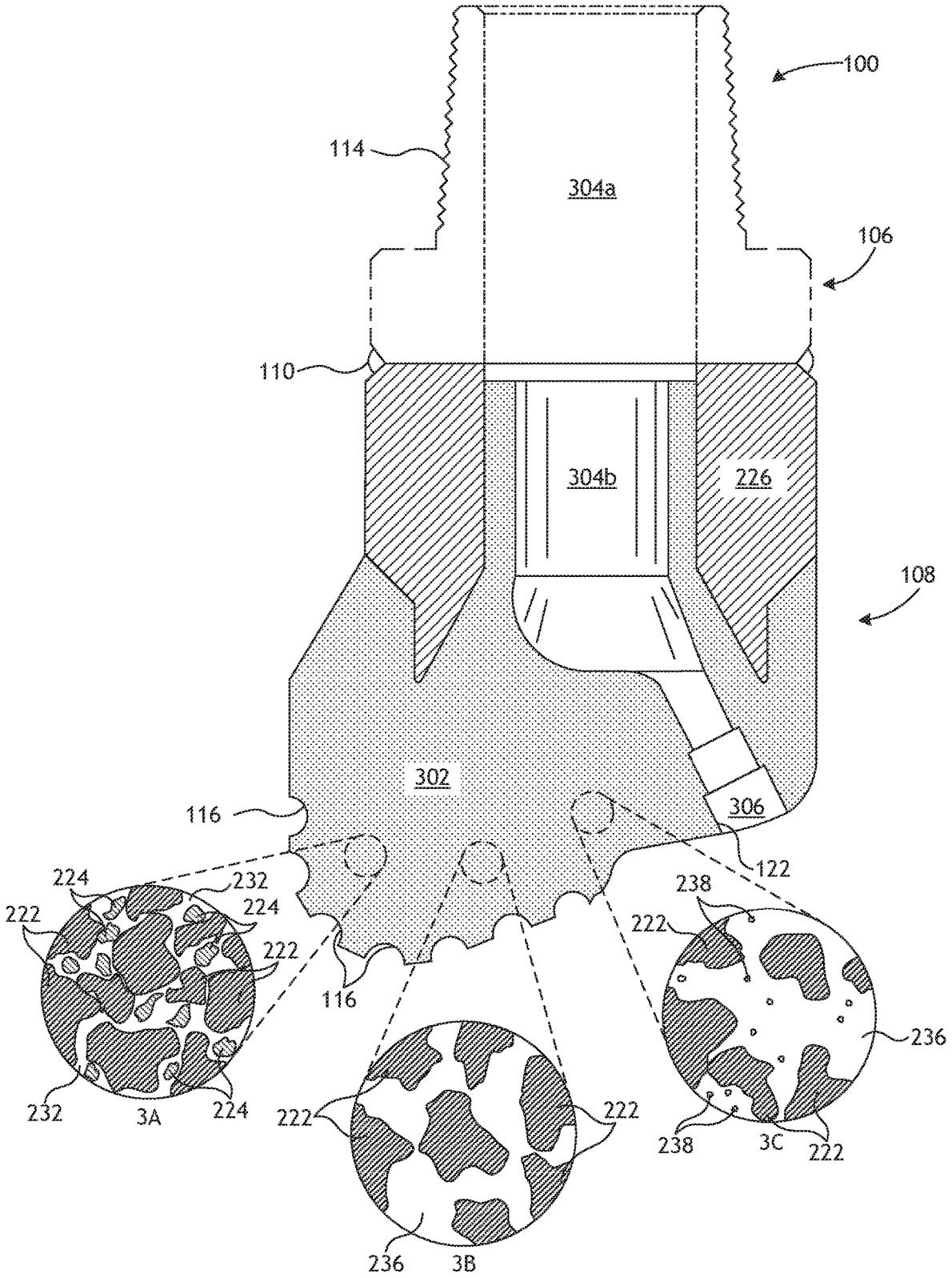
FIG. 3 is a cross-sectional view of the drill bit of FIG. 1.

FIG. 3 is a cross-sectional side view of the drill bit 100 of FIG. 1 following the above-described infiltration process within the mold assembly 200 of FIG. 2. Similar numerals from FIG. 1 that are used in FIG. 3 refer to similar components or elements that will not be described again. Once cooled, the mold assembly 200 of FIG. 2 may be broken away to expose the bit body 108, which now includes a reinforced composite material 302.

As illustrated, the shank 106 may be securely attached to the mandrel 226 at the weld 110 and the mandrel 226 extends into and forms part of the bit body 108. The shank 106 defines a first fluid cavity 304*a* that fluidly communicates with a second fluid cavity 304*b* corresponding to the location of the central displacement 218 (FIG. 2). The second fluid cavity 304*b* extends longitudinally into the bit body 108, and at least one flow passageway 306 (one shown) may extend from the second fluid cavity 304*b* to exterior portions of the bit body 108. The flow passageway(s) 306 correspond to the location of the leg displacement(s) 214 (FIG. 2). The nozzle openings 122 (one shown in FIG. 3) are defined at the ends of the flow passageway(s) 306 at the exterior portions of the bit body 108, and the pockets 116 are depicted as being formed about the periphery of the bit body 108 and are shaped to receive the cutting elements 118 (FIG. 1).

The reinforcement material 222 (alternately referred to as "a matrix powder") may include various types of powder reinforcing particles. Suitable types of reinforcing particles include, but are not limited to, particles of metals, metal alloys, superalloys, intermetallics, borides, carbides, nitrides, oxides, ceramics, diamonds, and the like, or any combination thereof.

Examples of suitable reinforcing particles include, but are not limited to, tungsten, molybdenum, niobium, tantalum, rhenium, iridium, ruthenium, beryllium, titanium, chromium, rhodium, iron, cobalt, uranium, nickel, nitrides, silicon nitrides, boron nitrides, cubic boron nitrides, natural diamonds, synthetic diamonds, cemented carbide, spherical carbides, low-alloy sintered materials, cast carbides, silicon carbides, boron carbides, cubic boron carbides, molybdenum carbides, titanium carbides, tantalum carbides, niobium carbides, chromium carbides, vanadium carbides, iron carbides, tungsten carbides, macrocrystalline tungsten carbides, cast tungsten carbides, crushed sintered tungsten carbides, carburized tungsten carbides, steels, stainless steels, austenitic steels, ferritic steels, martensitic steels, precipitation-hardening steels, duplex stainless steels, ceramics, iron alloys, nickel alloys, cobalt alloys, chromium alloys, HASTELLOY® alloys (i.e., nickel-chromium containing alloys, available from Haynes International), INCONEL® alloys (i.e., austenitic nickel-chromium containing superalloys available from Special Metals Corporation), WASPALOYS® (i.e., austenitic nickel-based superalloys), RENE® alloys (i.e., nickel-chromium containing alloys available from Altemp Alloys, Inc.), HAYNES® alloys (i.e., nickel-chromium containing superalloys available from Haynes International), INCOLOY® alloys (i.e., iron-nickel containing superalloys available from Mega Mex), MP98T (i.e., a nickel-copper-chromium superalloy available from SPS Technologies), TMS alloys, CMSX® alloys (i.e., nickel-based superalloys available from C-M Group), cobalt alloy 6B (i.e., cobalt-based superalloy available from HPA), N-155 alloys, any mixture thereof, and any combination thereof. In some embodiments, the reinforcing particles may be coated, such as diamond coated with titanium. In some embodiments, the selection of the reinforcing particles may be based on the type of binder material 232 or binder alloy system used to infiltrate the reinforcement material 222 and the metallic component 224. In such cases, the reinforcing particles may be selected to be refractory to the binder material 232 or binder alloy system.

Suitable materials for the metallic component 224 include, but are not limited to, titanium, chromium, iron, cobalt, nickel, manganese, copper, steels, stainless steels, austenitic steels, ferritic steels, martensitic steels, precipitation-hardening steels, duplex stainless steels, iron alloys, nickel alloys, cobalt alloys, chromium alloys, HASTELLOY® alloys (i.e., nickel-chromium containing alloys, available from Haynes International), INCONEL® alloys (i.e., austenitic nickel-chromium containing superalloys available from Special Metals Corporation), WASPALOYS® (i.e., austenitic nickel-based superalloys), RENE® alloys (i.e., nickel-chromium containing alloys available from Altemp Alloys, Inc.), HAYNES® alloys (i.e., nickel-chromium containing superalloys available from Haynes International), INCOLOY® alloys (i.e., iron-nickel containing superalloys available from Mega Mex), MP98T (i.e., a nickel-copper-chromium superalloy available from SPS Technologies), TMS alloys, CMSX® alloys (i.e., nickel-based superalloys available from C-M Group), cobalt alloy 6B (i.e., cobalt-based superalloy available from HPA), N-155 alloys, copper alloys (i.e., CuMnP), manganese alloys, any mixture thereof, and any combination thereof.

Suitable binder materials 232 include, but are not limited to, copper, nickel, cobalt, iron, aluminum, molybdenum, chromium, manganese, tin, zinc, lead, silicon, tungsten, boron, phosphorous, gold, silver, palladium, indium, any mixture thereof, any alloy thereof, and any combination thereof. Nonlimiting examples of alloys of the binder material 232 may include copper-phosphorus, copper-phosphorous-silver, copper-manganese-phosphorous, copper-nickel, copper-manganese-nickel, copper-manganese-zinc, copper-manganese-nickel-zinc, copper-nickel-indium, copper-tin-manganese-nickel, copper-tin-manganese-nickel-iron, gold-nickel, gold-palladium-nickel, gold-copper-nickel, silver-copper-zinc-nickel, silver-manganese, silver-copper-zinc-cadmium, silver-copper-tin, cobalt-silicon-chromium-nickel-tungsten, cobalt-silicon-chromium-nickel-tungsten-boron, manganese-nickel-cobalt-boron, nickel-silicon-chromium, nickel-chromium-silicon-manganese, nickel-chromium-silicon, nickel-silicon-boron, nickel-silicon-chromium-boron-iron, nickel-phosphorus, nickel-manganese, copper-aluminum, copper-aluminum-nickel, copper-aluminum-nickel-iron, copper-aluminum-nickel-zinc-tin-iron, and the like, and any combination thereof. Examples of commercially-available binder materials 232 include, but are not limited to, VIRGIN™ Binder 453D (copper-manganese-nickel-zinc, available from Belmont Metals, Inc.), and copper-tin-manganese-nickel and copper-tin-manganese-nickel-iron grades 516, 519, 523, 512, 518, and 520 available from ATI Firth Sterling; and any combination thereof.

As shown in the enlarged detail views of FIG. 3, the reinforced composite material 302 may comprise the reinforcement material 222 having the metallic component 224 dispersed therewith and infiltrated with the binder material 232. While loading the mixture or blend of the reinforcement material 222 and the metallic component 224 into the infiltration chamber 212 (FIG. 2), the metallic component 224 helps create separation between the reinforcing particles of the reinforcement material 222. During the infiltration process, the metallic component 224 melts and, in some instances, dissolves in the liquid binder material 232. The result is the creation of metallic pools within the final microstructure.

In some embodiments, as shown in the first enlarged detail view of FIG. 3, denoted as "3A", the metallic component 224 may be immiscible with the binder material 232. As used herein, the term "immiscible," relative to metal and/or metal alloy compositions, refers to two or more compositions that are unable to form an alloy. In such embodiments, the reinforced composite material 302 may comprise the reinforcement material 222 having the metallic component 224 dispersed therewith, where both the reinforcement material 222 and the metallic component 224 are infiltrated with the binder material 232.

In other embodiments, as shown in the enlarged detail view of FIG. 3B, denoted as "3B", the metallic component 224 may be miscible with the binder material 232. In such embodiments, the reinforced composite material 302 may comprise the reinforcement material 222 infiltrated with an alloy 236 of the binder material 232 and the metallic component 224. The resulting alloy 236 may provide improved strength, hardness, and/or erosion resistance to the resultant reinforced composite material 302 as compared to the un-alloyed binder material 232 shown in 3A.

In yet other embodiments, as shown in the enlarged detailed view of FIG. 3C, denoted as "3C", the miscibility between the metallic component 224 and the binder material 232 may result in the formation of intermetallic particles 238 dispersed in the alloy 236 of the binder material 232 and the metallic component 224. Generally, the intermetallic particles 238 are smaller and more abundant than the particles of the original metallic component 224. The intermetallic particles 238 may further improve the strength, hardness, and/or erosion resistance of the resultant reinforced composite material 302.

In each of the embodiments illustrated in 3A-3C, the separation of the reinforcing particles of the reinforcement material 222 resulting from inclusion of the metallic component 224 before infiltration may increase the strength and toughness of the resulting reinforced composite material 302 by allowing more strain to failure and blunting crack propagation.

According to embodiments of the present disclosure, the mechanical properties of the drill bit 100, particularly its strength and toughness, may be improved by optimizing one or more of the type, the quantity, and the size of the metallic component 224 dispersed with the reinforcement material 222 and included in the resulting reinforced composite material 302. Historically, the average particle size for the metallic component 224 dispersed with the reinforcement material 222 has been between about 75 microns and about 100 microns, which is often too large to separate smaller reinforcing particles of the reinforcement material 222, which can sometimes be less than 50 microns. Consequently, when using a metallic component consisting of particles sized between 75 and 100 microns, the smaller reinforcing particles of the reinforcement material 222 can remain clumped during infiltration and therefore not evenly dispersed in the microstructure of the resultant reinforced composite material 302.

Recent testing, however, has shown that improvements to the strength and toughness of the drill bit can be achieved when the particle size of the metallic component 224 is reduced to 50 microns or less when blended with the reinforcement material 222. More particularly, as compared to conventional particle sizes for the metallic component 224, which typically range between 75 and 100 microns, smaller particle sizes may result in the creation of a larger quantity of metallic pools with a small mean size that are more evenly dispersed throughout the resulting microstructure. This is because for a given mass of the metallic component 224, decreasing the particle size correspondingly increases the number of particles in the blend with the reinforcement material 222. As a result, this allows for a more even and homogenous separation of the reinforcing particles of the reinforcement material 222 by the smaller particles of the metallic component 224. In some embodiments, at least 25% of the particles of the metallic component 224 has a size of 50 microns or less. In some embodiments, at least 50% of the particles of the metallic component 224 has a size of 50 microns or less. In some embodiments, at least 75% of the particles of the metallic component 224 has a size of 50 microns or less. In some embodiments, at least 90% of the particles of the metallic component 224 has a size of 50 microns or less.

In some embodiments, the particle size of the metallic component 224 when blended with the reinforcement material 222 may be reduced to 40 microns or less, alternatively, 30 microns or less, alternatively, 20 microns or less, or alternatively, 10 microns or less, without departing from the scope of the disclosure. In some embodiments, at least 50% of the particles of the metallic component 224 may be 40 microns or less, alternatively, 30 microns or less, alternatively, 20 microns or less, or alternatively, 10 microns or less, without departing from the scope of the disclosure. In some embodiments, at least 75% of the particles of the metallic component 224 may be 40 microns or less, alternatively, 30 microns or less, alternatively, 20 microns or less, or alternatively, 10 microns or less, without departing from the scope of the disclosure. In some embodiments, at least 90% of the particles of the metallic component 224 may be reduced to 40 microns or less, alternatively, 30 microns or less, alternatively, 20 microns or less, or alternatively, 10 microns or less, without departing from the scope of the disclosure.

The total weight percentage (wt %) of the metallic component 224 as blended with the reinforcement materials 222 is also an important aspect of developing optimal reinforcement material blends. Specifically, controlling the wt % of small versus large particles in the metallic component 224 can affect the material properties of the reinforcement materials 222. Through testing and validation from laboratory data, it has been observed that having a metallic component 224 in the range of about 4 wt % to about 10 wt % as blended with the reinforcement material 222 is an optimal amount. Amounts less than 4 wt % tend to decrease the spacing between the reinforcing particles of the reinforcement material 222 too much, which reduces the overall strength and toughness of the resulting microstructure. Conversely, having a metallic component 224 present in amounts larger than 10 wt % tends to increase the spacing between the reinforcing particles 402 spacing too much, which can lead to decreased erosion resistance of the resulting microstructure.

Accordingly, an optimal blend of the metallic component 224 with the reinforcement material 222 includes the metallic component 224 as exhibiting a particle size of 50 microns or less and comprising about 4 wt % to about 10 wt % of the total reinforcement material 222. In at least one embodiment, the reinforcement material 222 may comprise tungsten carbide (WC) reinforcing particles blended with a nickel (Ni) or Ni alloy powder metallic component 224 in the range of about 2 wt % to about 15 wt %, but more preferably between about 4 wt % and about 10 wt %. In such embodiments, the binder material 232 used to infiltrate the blend of reinforcement material 222 and metallic component 224 may comprise a copper alloy, such as Cu—Mn—Ni—Zn. Nickel and nickel alloys used as the metallic component 224, in conjunction with a Cu—Mn—Ni—Zn binder material 232, may increase the resulting strength of the binder material 232 through the creation of NiMn intermetallics during infiltration. The alloy created in situ from the free Ni also possesses a melt range that reduces the porosity within the resulting microstructure, which would otherwise degrade the strength of the microstructure.

The reinforcing particles of the reinforcing material 222 may have a particle size distribution that is mono-modal or bi-modal. As used herein, the term "particle size distribution" refers to a list of values or a mathematical function that defines the relative amount by mass of particles present according to size. Particle size distribution may be determined using light scattering or statistical image analysis (e.g., using scanning electron micrographs).

In a mono-modal particle size distribution, the reinforcing particles of the reinforcing material 222 may be selected from one of: at least 25% (alternatively, 50%, 75%, or 90%) of the reinforcing particles are 100 microns or greater, at least 25% (alternatively, 50%, 75%, or 90%) of the reinforcing particles are 250 microns or greater, at least 25% (alternatively, 50%, 75%, or 90%) of the reinforcing particles are 500 microns or greater, at least 25% (alternatively, 50%, 75%, or 90%) of the reinforcing particles are 10 microns or less, at least 25% (alternatively, 50%, 75%, or 90%) of the reinforcing particles are 100 microns or less, or at least 25% (alternatively, 50%, 75%, or 90%) of the reinforcing particles are 250 microns or less.

In a bi-modal particle size distribution, the reinforcing material 222 may comprise two or more types of reinforcing particles distinguished by size. The higher size (diameter) mode may be selected from one of: at least 25% (alternatively, 50%, 75%, or 90%) of the reinforcing particles are 100 microns or greater, at least 25% (alternatively, 50%, 75%, or 90%) of the reinforcing particles are 250 microns or greater, or at least 25% (alternatively, 50%, 75%, or 90%) of the reinforcing particles are 500 microns or greater. The smaller size (diameter) mode may be selected from one of: at least 25% (alternatively, 50%, 75%, or 90%) of the reinforcing particles are 10 microns or less, at least 25% (alternatively, 50%, 75%, or 90%) of the reinforcing particles are 100 microns or less, or at least 25% (alternatively, 50%, 75%, or 90%) of the reinforcing particles are 250 microns or less.

For example, in some instances, the reinforcing material 222 may comprise first reinforcing particles with at least 25% (alternatively, 50%, 75%, or 90%) of the first reinforcing particles having a particle size of 50 microns or less and second reinforcing particles with at least 25% (alternatively, 50%, 75%, or 90%) of the second reinforcing particles having a particle size of 250 microns or greater. Alternatively, in some instances, the reinforcing material 222 may comprise first reinforcing particles with at least 25% (alternatively, 50%, 75%, or 90%) of the first reinforcing particles having a particle size of 10 microns or less and second reinforcing particles with at least 25% (alternatively, 50%, 75%, or 90%) of the second reinforcing particles having a particle size of 100 microns or greater. In some instances, the bi-modal particle size distribution for the reinforcing material 222 may be achieved by mixing two samples of reinforcing particles, where each sample corresponds to a distinct size mode. Once the two samples of reinforcing particles have been mixed, the particle size distribution for each mode may be determined by light scattering and peak fitting to each of the modes, for example, using functions like Gaussian, Lorentzian, Voigt, exponentially-modified Gaussian, and combinations thereof.

Generally, when using a reinforcing material 222 with a bi-modal particle size distribution, the particle size distribution of the metallic component 224 should be similar to or smaller than the smaller diameter mode of the bi-modal particle size distribution. For example, the reinforcing material 222 may comprise first reinforcing particles with at least 25% of the first reinforcing particles having a particle size of 50 microns or less and second reinforcing particles with at least 25% of the second reinforcing particles having a particle size of 250 microns or greater, and the metallic component 224 may have at least 25% (alternatively, 50%, 75%, or 90%) of the particles with a particle size of 50 microns or less (alternatively, 40 microns or less, 30 microns or less, 20 microns or less, or 10 microns or less).

To facilitate a better understanding of the present disclosure, the following test data and examples of preferred or representative embodiments are given. In no way should the following examples be read to limit or define the scope of the disclosure.

Figure 4A:
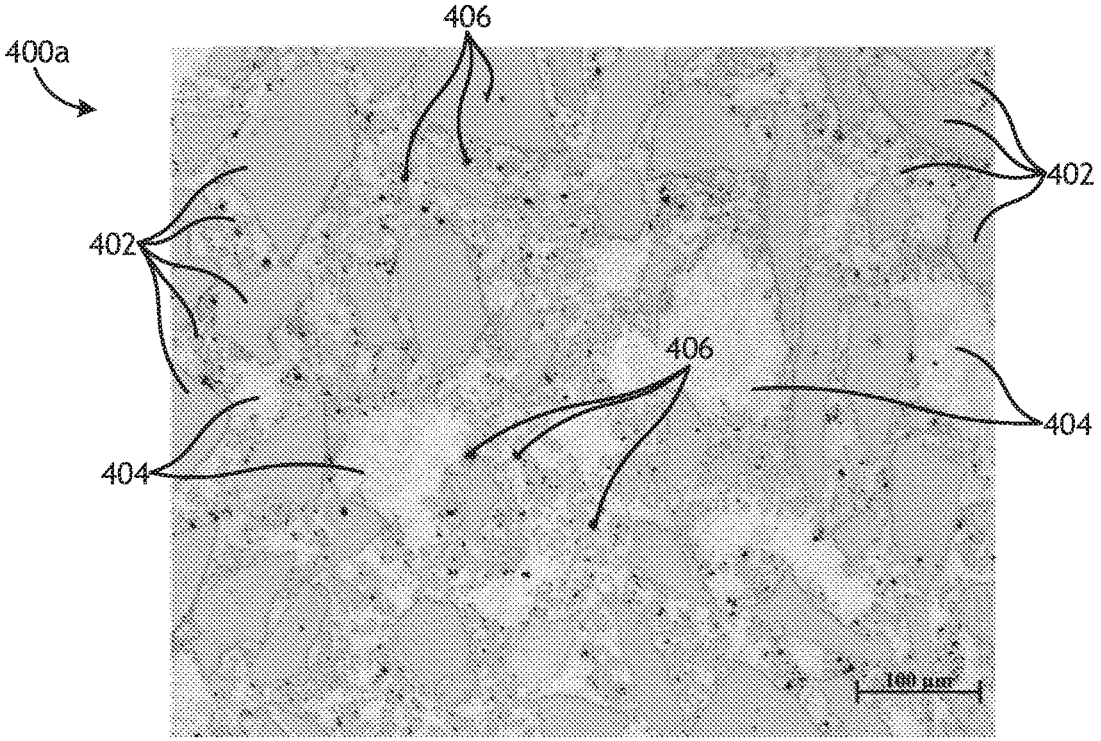
FIGS. 4A-4C are magnified micrograph images of three composite microstructures.
Figure 4B:
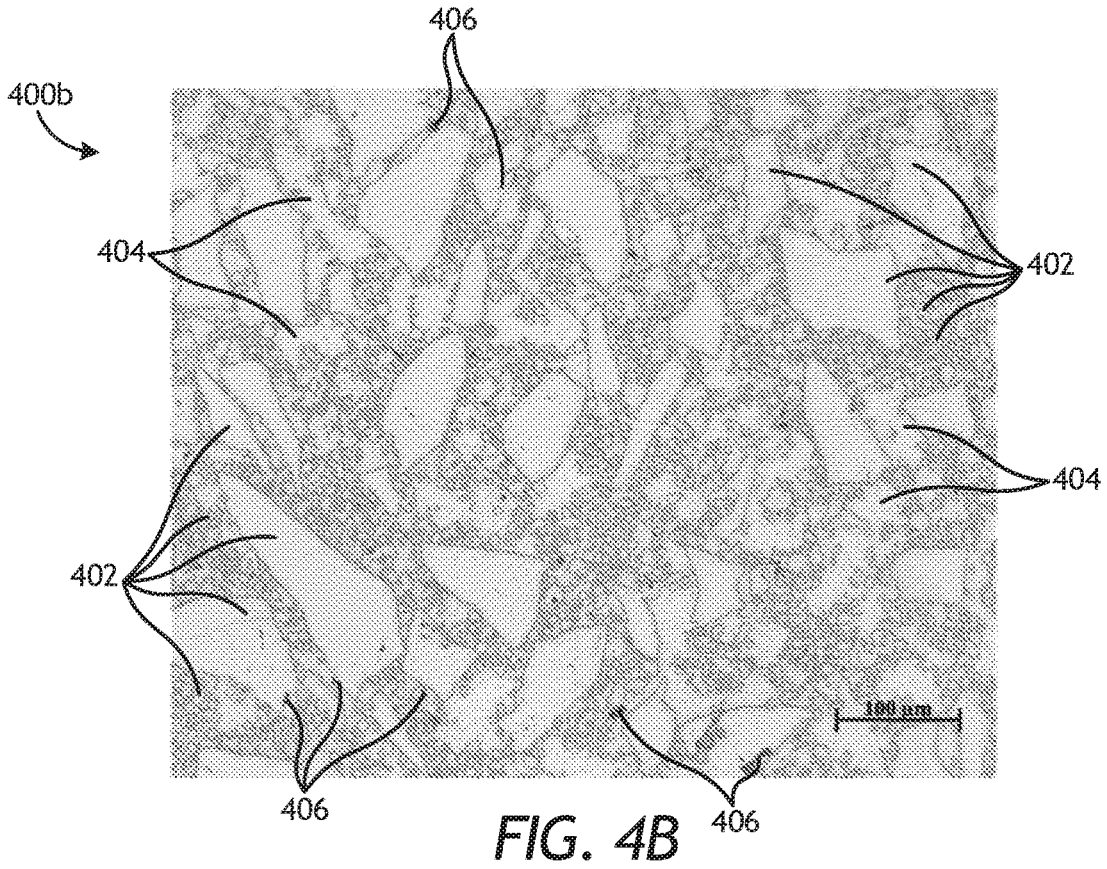
Figure 4C:
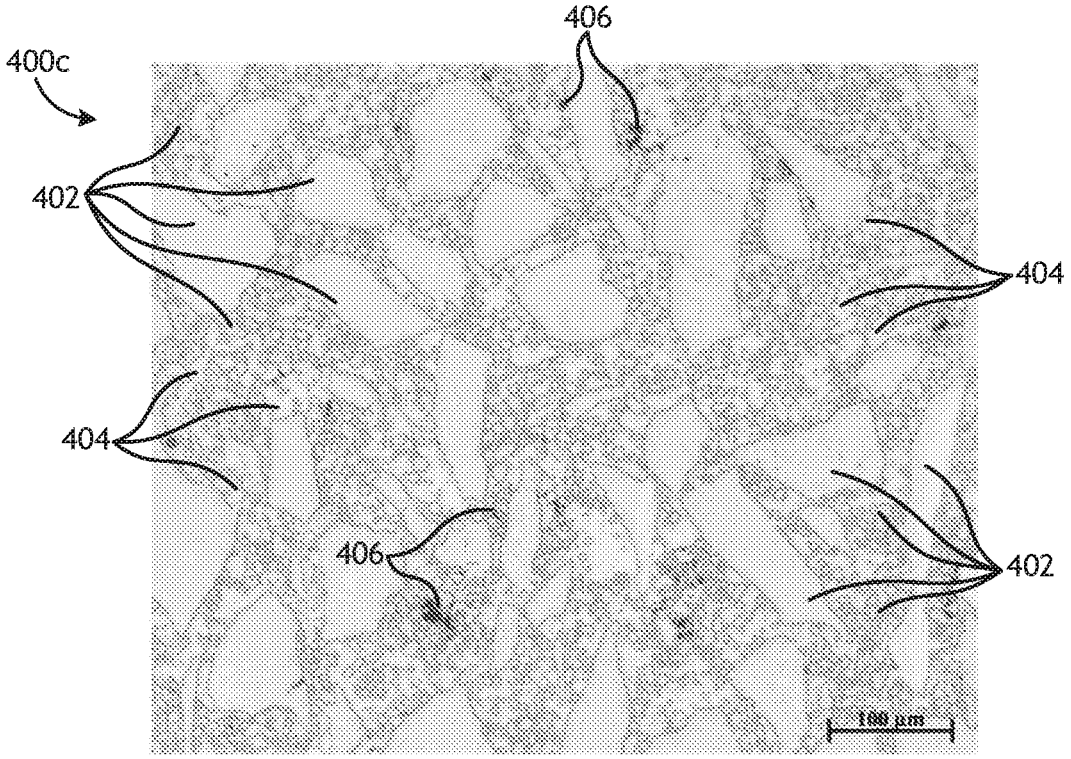

FIGS. 4A-4C are magnified micrograph images of three composite microstructures 400*a*, 400*b*, and 400*c*, respectively. Each of the composite microstructures 400*a-c* may be comparable to the composite material 302 of FIG. 3 (e.g., the enlarged detail view of FIG. 3), and each exhibits a varying size of the metallic component 224 (FIG. 3) as blended with the reinforcement materials 222 (FIG. 3) and infiltrated with the binder material 232 (FIG. 3).

In each composite microstructure 400*a-c*, reinforcing particles 402 of the reinforcement materials 222 (FIG. 3) can be observed interspersed amongst a plurality of binder pools 404. The binder pools 404 comprise the metallic component 224 (FIG. 3) melted or dissolved into the binder material 232 (FIG. 3) resulting from the above-described infiltration process. The reinforcing particles 402 in each composite microstructure 400*a-c* comprise particles of tungsten carbide (WC) and exhibit a particle size ranging between about 10 microns and 100 microns. The metallic component 224 in each composite microstructure 400*a-c* comprises particles of nickel (Ni), but could alternatively comprise any of the materials mentioned herein that would be suitable for the metallic component 224. The wt % of the Ni metallic component 224 in each microstructure 400*a-c* may range between 4-8%, which may also include a CuMnP component included in this total.

FIG. 4A is a micrograph of a first composite microstructure 400*a*, which comprises a baseline or standard drill bit microstructure where the metallic component 224 exhibits a particle size ranging between about 70 microns to about 100 microns. As can be seen, large binder pools 404 result amongst the reinforcing particles 402, which indicate large areas within the first composite microstructure 400*a* that are not optimally reinforced and, therefore, will result in lower strength and toughness. Moreover, it can be seen in FIG. 4A that the smaller reinforcing particles 402 remain clumped together and are otherwise not evenly dispersed in the microstructure. This can also lead to reduced strength and toughness. Lastly, the first composite microstructure 400*a* shows a large existence of voids 406, which represent porosity in the first composite microstructure 400*a*. Porosity can lead to cracking and, therefore, the voids 406 represent another deficiency in the mechanical properties of the first composite microstructure 400*a*.

In FIG. 4B, the second composite microstructure 400*b* is formed with the metallic component 224 having a particle size of about 40 microns. As compared to the first composite microstructure 400*a*, the smaller reinforcing particles 402 of the second composite microstructure 400*b* are spread out more evenly, which results in the size of the binder pools 404 being much smaller. Smaller binder pools 404 result in increased strength and toughness as the reinforcing particles 402 are able to form a more homogenous microstructure. Moreover, the second composite microstructure 400*b* shows a lower presence of voids 406 as compared to the first composite microstructure 400*a* of FIG. 4A, which also increases the mechanical properties of the second composite microstructure 400*b* as compared to the first composite microstructure 400*a* of FIG. 4A.

In FIG. 4C, the third composite microstructure 400*c* is formed with the metallic component 224 having a particle size of about 10 microns. Notably, the size of the binder pools 404 in the third composite microstructure 400*c* are even smaller as compared to the first and second composite microstructures 400*a,b*, and the smaller reinforcing particles 402 are more evenly spread out. The third composite microstructure 400*b* also shows a decreased presence of voids 406 as compared to the first and second composite microstructures 400*a,b*.

Accordingly, it has been observed through comparative analysis of the composite microstructures 400*a-c* that by lowering the particle size of the metallic component 224 as blended with the reinforcing particles 402, a marked decrease in porosity in the resulting microstructure is obtained. Moreover, as the particle size of the metallic component 224 decreases, the size of the resulting binder pools 404 correspondingly decrease since the smaller particles of the metallic component 224 are able to more evenly spread out into the reinforcing particles 404. This noted effect on the binder pools 404 was unexpected since the binder pools 404 were originally thought to be caused by packing faults or inconsistencies in the reinforcement materials 222 (FIG. 3) blended with the metallic component 224 (i.e., areas where particles were not efficiently packed). Moreover, it was originally thought that the metallic component 224 would melt or diffuse into the binder.

Figure 5:
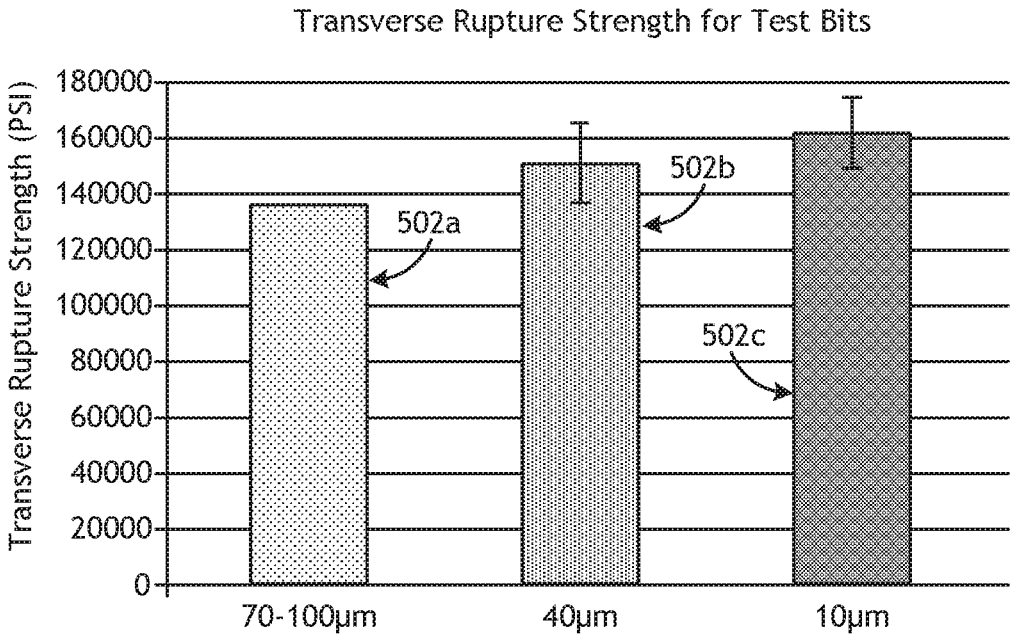
FIG. 5 is a bar chart showing transverse rupture strength values as a function of decreasing particle size of the metallic component blended with the reinforcement materials.

FIG. 5 is a bar chart showing transverse rupture strength (TRS; standard ASTM B406 test) values as a function of decreasing particle size of the metallic component blended with the reinforcement material. More specifically, the first bar 502*a* corresponds to test data obtained from a microstructure similar to the first composite microstructure 400*a* of FIG. 4A, the second bar 502*b* corresponds to test data obtained from a microstructure similar to the second composite microstructure 400*b* of FIG. 4B, and the third bar 502*c* corresponds to test data obtained from a microstructure similar to the third composite microstructure 400*c* of FIG. 4C. Accordingly, the test data in each bar 502*a-c* represents microstructures having WC reinforcing particles exhibiting a particle size ranging between about 10 microns and 100 microns and blended with a Ni metallic component having the same wt % concentration (e.g., ranging between about 4 wt % and about 10 wt %). Each bar 502*a-c* represents an average of ten test samples and the corresponding results obtained.

The Ni metallic component represented in the first bar 502*a* exhibits a particle size of about 70 microns to about 100 microns. By decreasing the particle size of the Ni metallic component to about 40 microns, as represented in the second bar 502*b*, the measured TRS increased about 14,000 psi. By further decreasing the particle size of the Ni metallic component to about 10 microns, as represented in the third bar 502*c*, the measured TRS increased another 10,000 psi to about 24,000 psi greater than the 70-100 micron example. Accordingly, each bar 502*a-c* represents different particle sizes of the Ni metallic component as blended into the same WC reinforcing particles and at the same wt % concentration. The only difference was the particle sizes of the Ni metallic component, and the bars 502*a-c* demonstrate the result effect of smaller particle size.

Figure 6:
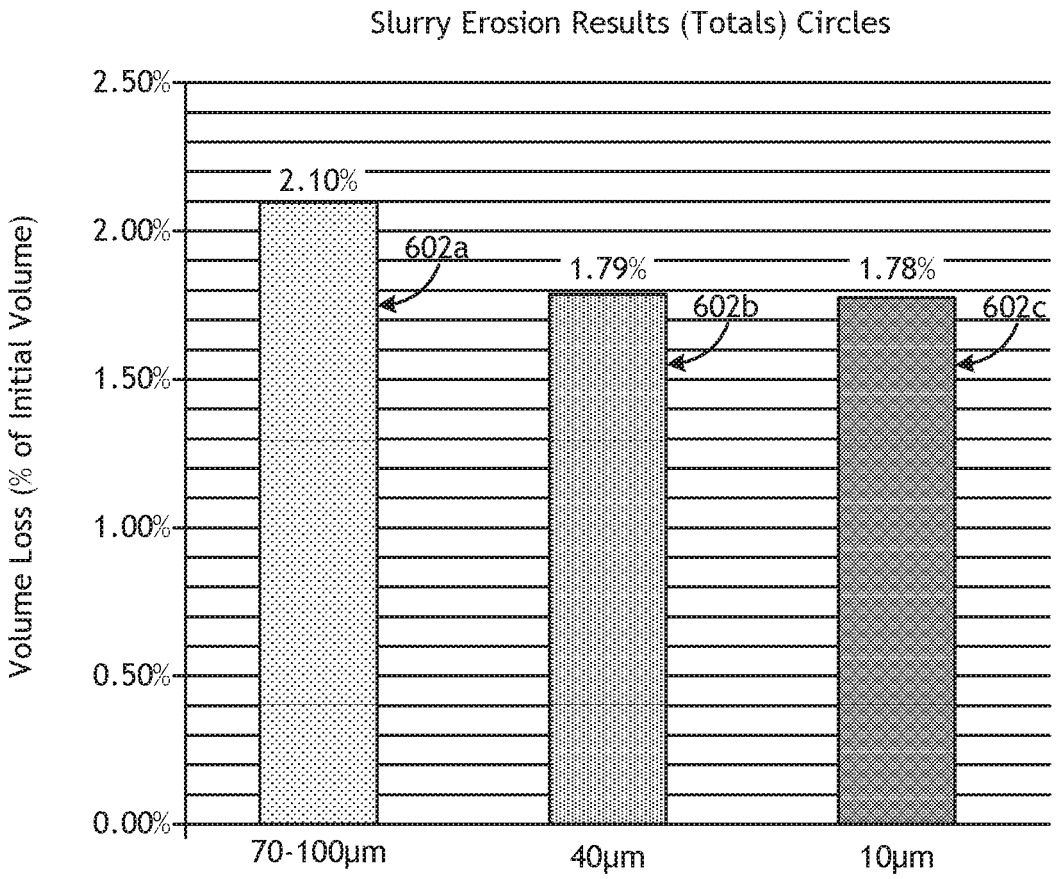
FIG. 6 is a bar chart showing the results of a slurry erosion volume loss test as a function of decreasing particle size of the metallic component blended with the reinforcement material.

FIG. 6 is a bar chart showing the results of a slurry erosion volume loss test as a function of decreasing particle size of the metallic component blended with the reinforcement material. Similar to the bar chart of FIG. 5, the bars of the bar chart of FIG. 6 correspond to the microstructures of the composite microstructures 400*a-c* of FIGS. 4A-4C. More specifically, the first bar 602*a* corresponds to test data obtained from a microstructure similar to the first composite microstructure 400*a* of FIG. 4A, the second bar 602*b* corresponds to test data obtained from a microstructure similar to the second composite microstructure 400*b* of FIG. 4B, and the third bar 602*c* corresponds to test data obtained from a microstructure similar to the third composite microstructure 400*c* of FIG. 4C. Accordingly, the test data in each bar 602*a-c* represents microstructures having WC reinforcing particles exhibiting a particle size ranging between about 10 microns and 100 microns and blended with a Ni metallic component having the same wt % concentration (e.g., ranging between about 4 wt % and about 10 wt %).

The Ni metallic component represented in the first bar 602*a* exhibits a particle size of about 70 microns to about 100 microns, and the resulting slurry erosion volume loss was measured at 2.10%. By decreasing the particle size of the Ni metallic component to about 40 microns, as represented in the second bar 602*b*, the measured slurry erosion volume loss decreased to 1.79%. By further decreasing the particle size of the Ni metallic component to about 10 microns, as represented in the third bar 602*c*, the measured slurry erosion volume loss decreased even further to 1.78%. Accordingly, each bar 602*a-c* represents different particle sizes of the Ni metallic component as blended into the same WC reinforcing particles and at the same wt % concentration. The only difference was the particle sizes of the Ni metallic component, and the bars 602*a-c* demonstrate the result effect of smaller particle size.

Embodiments described herein include, but are not limited to:

A: A metal-matrix composite (MMC) comprising a reinforced composite material including reinforcement material dispersed in a binder material, wherein the reinforcement material includes a metallic component dispersed with reinforcing particles and at least 25 percent of the metallic component has a particle size of 50 microns or less.

B: A drill bit, comprising: a bit body; and a plurality of cutting elements coupled to an exterior of the bit body, wherein at least a portion of the bit body comprises a reinforced composite material including reinforcement material dispersed in a binder material, wherein the reinforcement material includes a metallic component dispersed with reinforcing particles and at least 25 percent of the metallic component has a particle size of 50 microns or less.

C: A method of fabricating a metal-matrix composite (MMC), comprising: loading a reinforcement material into a mold cavity, wherein the reinforcement material includes a metallic component dispersed with reinforcing particles and at least 25 percent of the metallic component has a particle size of 50 microns or less; and infiltrating the reinforcement material with a binder material at a temperature sufficient to melt the metallic component and the binder material.

Embodiments A, B, and C may optionally further include one or more of the following: Element 1: wherein the reinforcing particles are tungsten carbide particles and the metallic component comprises nickel or a nickel alloy; Element 2: wherein the binder material is a copper alloy; Element 3: wherein the metallic component is dispersed with the reinforcement material at a concentration ranging between 2 wt % and 15 wt %; Element 4: wherein the metallic component is dispersed with the reinforcement material at a concentration ranging between 4 wt % and 10 wt %; Element 5: wherein the metallic component is selected from the group consisting of titanium, chromium, iron, cobalt, nickel, manganese, copper, steels, stainless steels, austenitic steels, ferritic steels, martensitic steels, precipitation-hardening steels, duplex stainless steels, iron alloys, nickel alloys, cobalt alloys, chromium alloys, copper alloys, manganese alloys, and any combination thereof; Element 6: wherein the MMC tool is a tool selected from the group consisting of an oilfield drill bit or cutting tool, a non-retrievable drilling component, an aluminum drill bit body associated with casing drilling of wellbores, a drill-string stabilizer, a cone for roller-cone drill bits, a model for forging dies used to fabricate support arms for roller-cone drill bits, an arm for fixed reamers, an arm for expandable reamers, an internal component associated with expandable reamers, a sleeve attachable to an uphole end of a rotary drill bit, a rotary steering tool, a logging-while-drilling tool, a measurement-while-drilling tool, a side-wall coring tool, a fishing spear, a washover tool, a rotor, a stator and/or housing for downhole drilling motors, blades for downhole turbines, armor plating, an automotive component, a bicycle frame, a brake fin, an aerospace component, a turbopump component, and any combination thereof; Element 7: wherein at least 90 percent of the particle size of the metallic component is 50 microns or less; Element 8: wherein at least 50 percent of the particle size of the metallic component is 20 microns or less; Element 9: wherein at least 50 percent of the particle size of the metallic component is 10 microns or less; Element 10: wherein at least 75 percent of the particle size of the metallic component is 10 microns or less; Element 11: wherein at least 90 percent of the particle size of the metallic component is 20 microns or less; Element 12: wherein at least 75 percent of the particle size of the metallic component is 25 microns or less; Element 13: wherein at least 90 percent of the particle size of the metallic component is 10 microns or less; Element 14: wherein the reinforcing particles comprise: first reinforcing particles with at least 25 percent of the first reinforcing particles having a particle size of 50 microns or less; and second reinforcing particles with at least 25 percent of the second reinforcing particles having a particle size of 250 microns or greater; and Element 15: wherein the reinforcing particles comprise: first reinforcing particles with at least 50 percent of the first reinforcing particles having a particle size of 10 microns or less; and second reinforcing particles with at least 50 percent of the second reinforcing particles having a particle size of 100 microns or greater. Embodiment C may optionally (alone or in combination with one of the foregoing) further comprise Element 16: wherein infiltrating the reinforcement material with the binder material comprises forming an alloy between the binder material and the metallic component while infiltrating the reinforcement material with a binder material, and optionally further comprise Element 17: wherein infiltrating the reinforcement material with the binder material comprises diffusing or mixing the metallic component with the binder material during infiltration and thereby creating intermetallic particles.

By way of nonlimiting example, Embodiments A, B, and C may further comprise the following combinations of elements: Elements 1 and 2 in combination; Element 3 or 4 in combination with one or both of Elements 1 and 2; Elements 3 or 4 in combination with Element 5 and optionally Element 2; Element 5 (and optionally with Element 2) in combination with one or both of Elements 1 and 2; Element 6 in combination with one or both of Elements 1 and 2 and optionally in further combination with Element 3 or 4; Element 6 in combination with one or both of Elements 5 and 2 and optionally in further combination with Element 3 or 4; Element 6 in combination with Element 3 or 4; one of Elements 7-15 in combination with one or both of Elements 1 and 2 and optionally in further combination with Element 3 or 4 and/or Element 6; one of Elements 7-15 in combination with one or both of Elements 5 and 2 and optionally in further combination with Element 3 or 4 and/or Element 6; and one of Elements 7-15 in combination with Element 3 or 4.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. The particular illustrative embodiments disclosed above may be altered, combined, or modified and all such variations are considered within the scope of the present disclosure. The systems and methods illustratively disclosed herein may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A metal-matrix composite (MMC) comprising a reinforced composite material including reinforcement material dispersed in a binder material, wherein the reinforcement material includes a metallic component dispersed with reinforcing particles and at least 25 percent of the metallic component has a particle size of 50 microns or less, wherein a particle size distribution of the reinforcing particles is mono-modal or bi-modal, wherein at least 25 percent of the reinforcing particles have a particle size of 250 microns or more;

wherein the reinforcing particles comprise:

first reinforcing particles with at least 25 percent of the first reinforcing particles having a particle size of 50 microns or less; and second reinforcing particles with at least 25 percent of the second reinforcing particles having a particle size of 250 microns or greater.

2. The MMC of claim 1, wherein the reinforcing particles are tungsten carbide particles and the metallic component comprises nickel or a nickel alloy.

3. The MMC of claim 2, wherein the binder material is a copper alloy.

4. The MMC of claim 1, wherein the metallic component is dispersed with the reinforcement material at a concentration ranging between 2 wt % and 15 wt %.

5. The MMC of claim 1, wherein the metallic component is dispersed with the reinforcement material at a concentration ranging between 4 wt % and 10 wt %.

6. The MMC of claim 1, wherein the metallic component is selected from the group consisting of titanium, chromium, iron, cobalt, nickel, manganese, copper, steels, stainless steels, austenitic steels, ferritic steels, martensitic steels, precipitation-hardening steels, duplex stainless steels, iron alloys, nickel alloys, cobalt alloys, chromium alloys, copper alloys, manganese alloys, and any combination thereof.

7. The MMC of claim 1, wherein the MMC tool is a tool selected from the group consisting of an oilfield drill bit or cutting tool, a non-retrievable drilling component, an aluminum drill bit body associated with casing drilling of wellbores, a drill-string stabilizer, a cone for roller-cone drill bits, a model for forging dies used to fabricate support arms for roller-cone drill bits, an arm for fixed reamers, an arm for expandable reamers, an internal component associated with expandable reamers, a sleeve attachable to an uphole end of a rotary drill bit, a rotary steering tool, a logging-while-drilling tool, a measurement-while-drilling tool, a side-wall coring tool, a fishing spear, a washover tool, a rotor, a stator and/or housing for downhole drilling motors, blades for downhole turbines, armor plating, an automotive component, a bicycle frame, a brake fin, an aerospace component, a turbopump component, and any combination thereof.

8. The MMC of claim 1, wherein at least 90 percent of the particle size of the metallic component is 50 microns or less.

9. The MMC of claim 1, wherein at least 50 percent of the particle size of the metallic component is 20 microns or less.

10. A metal-matrix composite (MMC) comprising a reinforced composite material including reinforcement material dispersed in a binder material, wherein the reinforcement material includes a metallic component dispersed with reinforcing particles and at least 25 percent of the metallic component has a particle size of 50 microns or less, wherein a particle size distribution of the reinforcing particles is mono-modal or bi-modal, wherein at least 25 percent of the reinforcing particles have a particle size of 250 microns or more;

wherein the reinforcing particles comprise:

first reinforcing particles with at least 50 percent of the first reinforcing particles having a particle size of 10 microns or less; and second reinforcing particles with at least 50 percent of the second reinforcing particles having a particle size of 100 microns or greater.

11. A drill bit, comprising:

a bit body; and a plurality of cutting elements coupled to an exterior of the bit body, wherein at least a portion of the bit body comprises a reinforced composite material including reinforcement material dispersed in a binder material, wherein the reinforcement material includes a metallic component dispersed with reinforcing particles and at least 25 percent of the metallic component has a particle size of 50 microns or less, wherein a particle size distribution of the reinforcing particles is mono-modal or bi-modal, wherein at least 25 percent of the reinforcing particles have a particle size of 250 microns or more;

wherein the reinforcing particles comprise:

first reinforcing particles with at least 25 percent of the first reinforcing particles having a particle size of 50 microns or less; and second reinforcing particles with at least 25 percent of the second reinforcing particles having a particle size of 250 microns or greater.

12. The drill bit of claim 11, wherein the reinforcing particles are tungsten carbide particles, the metallic component comprises nickel or a nickel alloy, and the binder material comprises a copper alloy.

13. The drill bit of claim 11, wherein the metallic component is dispersed with the reinforcing particles at a concentration ranging between 2 wt % and 15 wt %.

14. A method of fabricating a metal-matrix composite (MMC), comprising:

loading a reinforcement material into a mold cavity, wherein the reinforcement material includes a metallic component dispersed with reinforcing particles and at least 25 percent of the metallic component has a particle size of 50 microns or less, wherein at least 25 percent of the reinforcing particles have a particle size of 250 microns or more; and infiltrating the reinforcement material with a binder material at a temperature sufficient to melt the metallic component and the binder material;

wherein the reinforcing particles comprise:

first reinforcing particles with at least 25 percent of the first reinforcing particles having a particle size of 50 microns or less; and second reinforcing particles with at least 25 percent of the second reinforcing particles having a particle size of 250 microns or greater.

15. The method of claim 14, wherein infiltrating the reinforcement material with the binder material comprises forming an alloy between the binder material and the metallic component while infiltrating the reinforcement material with a binder material.

16. The method of claim 15, wherein infiltrating the reinforcement material with the binder material comprises diffusing or mixing the metallic component with the binder material during infiltration and thereby creating intermetallic particles.

17. The method of claim 15, wherein the reinforcing particles are tungsten carbide particles, the metallic component comprises nickel or a nickel alloy, and the binder material comprises a copper alloy.

18. The method of claim 15, wherein loading the reinforcement material into the mold cavity comprises loading a blend of the reinforcing particles and the metallic component into the mold cavity where the metallic component is dispersed with the reinforcing particles at a concentration ranging between 2 wt % and 15 wt %.

19. The method of claim 15, wherein loading the reinforcement material into the mold cavity comprises loading a blend of the reinforcing particles and the metallic component into the mold cavity where the metallic component is dispersed with the reinforcing particles at a concentration ranging between 4 wt % and 10 wt %.

20. A drill bit, comprising:

a bit body; and a plurality of cutting elements coupled to an exterior of the bit body, wherein at least a portion of the bit body comprises a reinforced composite material including reinforcement material dispersed in a binder material, wherein the reinforcement material includes a metallic component dispersed with reinforcing particles and at least 25 percent of the metallic component has a particle size of 50 microns or less, wherein a particle size distribution of the reinforcing particles is mono-modal or bi-modal, wherein at least 25 percent of the reinforcing particles have a particle size of 250 microns or more;

wherein the reinforcing particles comprise:

first reinforcing particles with at least 50 percent of the first reinforcing particles having a particle size of 10 microns or less; and second reinforcing particles with at least 50 percent of the second reinforcing particles having a particle size of 100 microns or greater.

21. A method of fabricating a metal-matrix composite (MMC), comprising:

loading a reinforcement material into a mold cavity, wherein the reinforcement material includes a metallic component dispersed with reinforcing particles and at least 25 percent of the metallic component has a particle size of 50 microns or less, wherein at least 25 percent of the reinforcing particles have a particle size of 250 microns or more; and infiltrating the reinforcement material with a binder material at a temperature sufficient to melt the metallic component and the binder material;

wherein the reinforcing particles comprise:

first reinforcing particles with at least 25 percent of the first reinforcing particles having a particle size of 50 microns or less; and second reinforcing particles with at least 25 percent of the second reinforcing particles having a particle size of 250 microns or greater.

* * * * *